US005809927A

United States Patent [19]

Grondin

[11] Patent Number: 5,809,927

[45] Date of Patent: Sep. 22, 1998

[54] DEVICE FOR CONTROLLING PIVOTING ELEMENTS

[75] Inventor: Claude Grondin, La Farled-Sur-Sollies-Pont, France

[73] Assignee: Etat Francais Represente Par Le Delegue General Pour L'Armement, Paris, France

[21] Appl. No.: 737,461

[22] PCT Filed: Mar. 7, 1996

[86] PCT No.: PCT/FR96/00358

§ 371 Date: Nov. 14, 1996

§ 102(e) Date: Nov. 14, 1996

[87] PCT Pub. No.: WO96/28342

PCT Pub. Date: Sep. 9, 1996

[30] Foreign Application Priority Data

Mar. 16, 1995 [FR] France ..... 95 03033

[51] Int. Cl.[6] ..... B63G 8/32

[52] U.S. Cl. ..... 714/316; 114/319

[58] Field of Search ..... 114/238, 316, 114/318, 319

[56] References Cited

FOREIGN PATENT DOCUMENTS

| | | | |
|---|---|---|---|
| 553125 | 5/1923 | France . | |
| 1132020 | 6/1965 | Germany . | |
| 131960 | 9/1919 | United Kingdom | 114/238 |

*Primary Examiner*—Sherman Basinger
*Attorney, Agent, or Firm*—Oliff & Berridge, PLC

[57] ABSTRACT

The invention relates to a device for controlling the kinematics of pivoting elements designed to open substantially simultaneously to allow a clear passage of a weapon in a weapon launch tube equipped with a weapon launch circuit via an air distributor on board a submarine. The invention includes on the axis of rotation of each pivoting element and on the axis of rotation of a rotary element connected to the air distributor, a mechanism for converting a rotation into a translation, a mechanism for converting a translation into a rotation, and an associated mechanism for quantifying these conversions. The mechanism for converting a translation into a rotation on the axis of rotation of the rotary element is activated by the mechanism for converting a rotation into a translation on the axis of rotation of each pivoting element in association with the quantification mechanisms.

7 Claims, 1 Drawing Sheet

DEVICE FOR CONTROLLING PIVOTING ELEMENTS

BACKGROUND OF THE INVENTION

The invention relates to a device for controlling the kinematics of doors designed to open simultaneously or nearly simultaneously to clear a free passage, particularly for an application relating to a submarine equipped with a weapon launch tube.

In such an application, a solid muzzle door, located between the thick hull of the submarine and a thin hull, and able to withstand the immersion pressure, seals the tube on the sea side.

The thin hull has an opening for passage of the weapons exiting the torpedo launch tube on the axis of the muzzle door. The opening is closed by a shutter door in the resting position.

In principle the weapons are wire-guided. Wire guidance is provided by a wire of suitable length protected by a flexible metal hosepipe. This hosepipe is vulnerable to friction at the sharp angles of the edges of the opening. To avoid damage to the hosepipe, a part called a hosepipe guide is installed in the shutter door, and activated when the shutter door opens. This part moves translationally and pivots to fall back onto an edge of the opening.

Before a weapon is launched outside the weapon launch tube, the muzzle door and the shutter door should be opened simultaneously or nearly simultaneously and the hosepipe guide should be caused to fall back. This clears a space for the weapon to pass through. This space is commonly known as "passage clearance."

The muzzle door is moved by a hydraulic press.

The shutter door, moved by kinematics which are known as "main kinematics" connected to the muzzle door, retracts from its initial position while the hosepipe guide, moved by the kinematics known as "secondary kinematics" which are connected either directly to the muzzle door or to the shutter door, falls back on an edge of the opening.

Opening of the muzzle door causes the shutter door to open and the hosepipe guide to be activated, and also opens an air distributor in the weapon launch air circuit.

With a view to operating safety, it is absolutely necessary to verify that all three elements (muzzle door, shutter door, and hosepipe guide) rotate completely, because if there is a break in the main kinematics or the secondary kinematics, the shutter door in the first case and the hosepipe guide in the second case will form an obstacle in the passage clearance.

The invention relates to a device for controlling the kinematics of elements that may form an obstacle.

Hence the invention relates to a device for controlling the kinematics of pivoting elements designed to open rotationally simultaneously or nearly simultaneously to allow a clear passage, particularly for doors and other pivoting elements that might constitute an obstacle to passage of a weapon in a weapon launch tube equipped with a weapon launch circuit via an air distributor on board a submarine. The invention is characterized in that it has, on the axis of rotation of each door or pivoting element, and on the axis of rotation of a rotary element connected to the air distributor, means for converting a rotation into a translation, means for converting a translation into a rotation, and associated means for quantifying these conversions. Additionally, the means for converting a translation into a rotation on the axis of rotation of the rotary element are activated by the means for converting a rotation into a translation on the axis of rotation of each door or pivoting element in association with the quantification means.

Preferably, the means for converting a rotation into a translation and/or the means for converting a translation into a rotation are structured of a pinion mechanically connected to a rack.

Preferably, the quantification means includes a piston connected to the rack.

The device according to the invention can be connected to an assembly for controlling the opening of the air distributor, with the opening actually occurring only if it corresponds to a predetermined rotation value for the rotary element in relation to the air distributor.

Other characteristics and advantages of the present invention will emerge from reading the description hereinbelow of a preferred embodiment provided for illustration of application to opening doors and at other pivoting elements in a weapon launch tube on board a submarine.

BRIEF DESCRIPTION OF THE DRAWINGS

The preferred embodiments of the invention will be described in detail, with reference to the following figures, wherein.

DETAILED DESCRIPTION OF PREFERRED EMBODIMENTS

Figure 1:
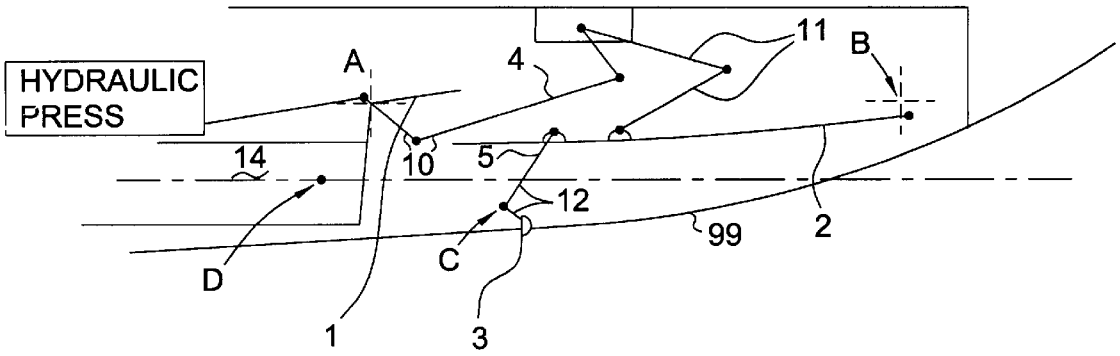
FIG. 1 is a diagram seen from above of all the elements set in motion in the opening kinematics of the muzzle door of a weapon launch tube in the bow of a submarine.

FIG. 1 shows the elements set in motion in the opening kinematics of the weapon launch tube 14 formed in a bow of a submarine hull 99 equipped with: a muzzle door 1, a shutter door 2 set in motion by a linkage arm assembly 4 including linkage arms 10 and 11; and a hosepipe guide 3 set in motion by a linkage arm assembly 5 including linkage arms 12. The hosepipe guide 3 is semicircular in cross-section and allows a hosepipe (not shown) to bend around the curve of the hosepipe guide 3.

The pivoting elements listed above: muzzle door 1, shutter door 2, and hosepipe guide 3 effect a rotation on axes perpendicular to the plane of FIG. 1 shown schematically as points A, B, and C, respectively.

When the muzzle door 1 opens, it pivots through an angle of 105°, the shutter door 2 by an angle of 13.5°, and the hosepipe guide 3 by an angle of 272°.

Opening of muzzle door 1 of the weapon launch tube drives rotationally, on an axis perpendicular to the plane of FIG. 1 shown schematically by point D, a rotary element in a form of a pinion 6 (shown in FIG. 2) belonging to a mechanical assembly linked to an air distributor located in series in the weapon launch air circuit. Operation of the weapon launch air circuit allows the weapon to be launched. The hosepipe guide 3 is designed according to the submarine and the shape of the shutter door 1. In the example of the invention, the hosepipe guide 3 is semicircular in cross-section and in elevation is in the shape of a crescent. However, the hosepipe guide 3 may be in another shape, as needed to avoid a launched weapon from striking the hosepipe guide 3 while at the same time allowing the hosepipe to pay out without breaking.

According to the invention, a housing able to withstand immersion pressure and containing a first set of means is provided. The first set of means is comprised of: (i) means for converting a rotation into a translation on these axes, (ii) means for converting a translation into a rotation on these axes, and (iii) associated means of quantifying these conversions. The first set of means is positioned on each of the three axes of rotation A, B, and C.

The means for converting a rotation into a translation are set in motion when the pivoting elements open on axes of rotation A, B, and C. The means for converting rotation into a translation are comprised in the example of FIG. 2 by the pinion 6 connected with a rack 7. The means for converting a translation into a rotation are, in this particular embodiment, comprised of the same means operating in reverse and are set in motion when the pivoting elements close.

Figure 2:
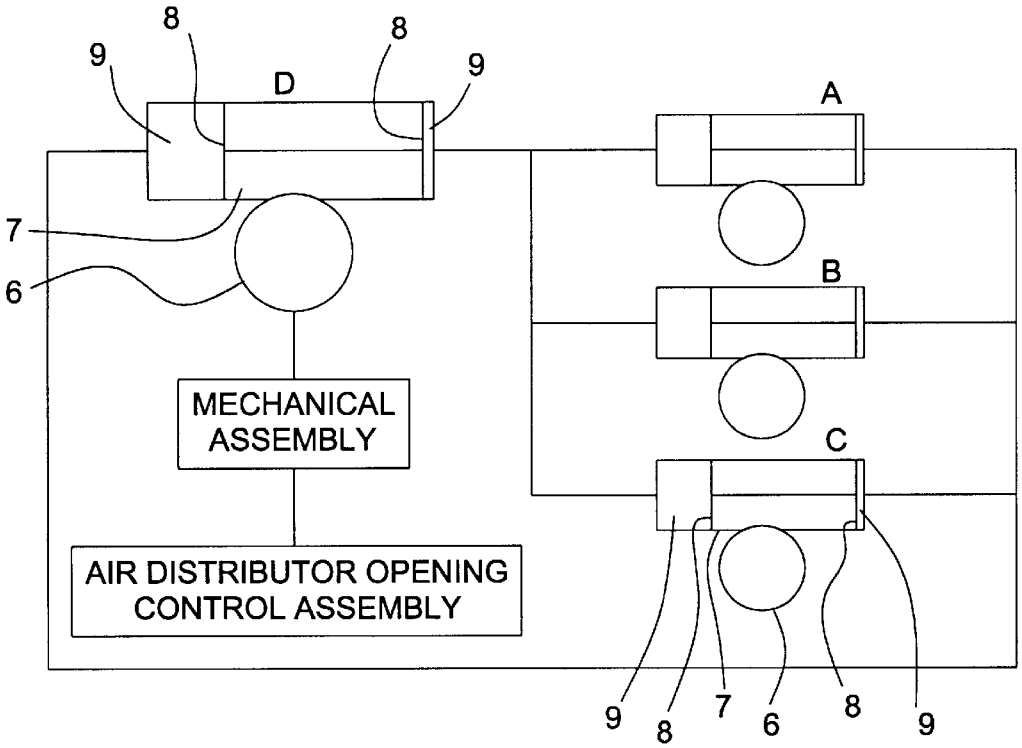
FIG. 2 is a diagram of the device according to the invention.

The means for quantifying rotation into translation comprise a piston 8 which moves a volume of oil inside a sealed chamber 9. FIG. 2 shows a piston 8 at each end of the racks 7. The pinion 6, relative to the rack 7, actually moves along the rack 7 in one direction when the pivoting elements open and in the other direction when these same elements close. The rack 7 causes the movement of the pistons to which it is connected and the pistons move a volume of oil relative to the rotation effected by the pinion 6.

By calculation, the exact three volumes are determined relative to the three rotations, and the sum of these three volumes of oil, which can be identical or different, is established.

According to the invention, a housing withstanding immersion pressure and comprising a set of means identical in their principle to the first set of means is provided on axis D. This set of means, which can be a rack connected to a pinion, for converting a rotation into a translation (being the same means but operating in the reverse direction) and means for quantifying these conversions which can be pistons displacing a volume of oil into a sealed chamber, is positioned on axis of rotation D. The translation converted into rotation on axis D corresponds to the sum of the three preceding volumes displaced by pistons 8 of the first set of means. The means for converting a translation into a rotation on axis D are such that the rotation has a predetermined value, which can be 60° for example.

The four housings positioned respectively on axes A, B, C, and D are connected hydraulically.

The operation of the sets of means according to the invention is as follows.

Upon opening of the pivoting elements on axes A, B, and C, the means for converting a rotation into a translation comprising a pinion related to a rack are activated. Since the rack is in relation to a piston which displaces a volume of oil, the three rotations on the three axes are hence quantified by volumes.

This first means beings about activation on axis D of other means identical in principle to the former means but having the reverse mode of operation. This second set of means converts a translation corresponding to the sum of the three preceding translations obtained after rotation on axes A, B, and C, into a rotation on axis D of the rotary element of the mechanical assembly connected to the air distributor.

Upon closure of the pivoting elements, the operating mode of the means according to the invention is reversed.

The housing positioned on axis D can be connected to a device for controlling opening of the air distributor.

If a mechanical part linked to the kinematics of one of the elements pivoting on one of axis A, B or C (such as the shutter door of the hosepipe guide 3 activated when the muzzle door 1 of a weapon launch tube is opened) breaks, the corresponding measured oil volume will be different from the expected volume and the three volumes added together will not give the predetermined value. As a result, calculation of the rotation of the mechanical elements triggering opening of the air distributor will not give the expected value and opening of the air distributor will not be authorized. In this case, the weapon will not be launched.

The device according to the invention allows all the rotary movements on board a submarine, or any other system requiring the same level of operating reliability, to be controlled.

What is claimed is:

1. A device for controlling the, kinematics of pivoting and rotary elements designed to open substantially simultaneously to allow a clear passage for a weapon in a weapon launch tube equipped with a weapon launch circuit via an air distributor on board a submarine, the device comprising:

a plurality of pivoting elements each pivotable about an axis of rotation;

a rotary element connected to the air distributor, said rotary element having an axis of rotation;

means for converting a rotation into a translation and for converting a translation into a rotation, and associated means for quantifying the conversions, said means for converting and said means for quantifying attached to the axis of rotation of each of said plurality of pivoting elements and said rotary element; and wherein said means for converting a translation into a rotation and for converting a rotation into a translation of said rotary element is activated by said means for converting a translation into a rotation and for converting a rotation into a translation of each pivoting element.

2. A device for controlling kinematics of pivoting and rotary elements according to claim 1, wherein each means for converting a translation into a rotation and for converting a rotation into a translation comprise a pinion mechanically connected to a rack.

3. A device for controlling kinematics of pivoting and rotary elements according to claim 2, wherein each said associated means for quantifying the conversions comprise a piston connected to said rack.

4. A device for controlling kinematics of pivoting and rotary elements according to claim 3, wherein the rotary element is connected to the air distributor with an air distributor opening control assembly, and wherein said air distributor opening control assembly is activated only if a predetermined rotation is imparted to said rotary element relative to the air distributor.

5. A device for controlling kinematics of pivoting and rotary elements according to claim 1, wherein each said associated means for quantifying the conversions comprise a piston connected to a rack.

6. A device for controlling kinematics of pivoting and rotary elements according to claim 5, wherein the rotary element is connected to the air distributor with an air distributor opening control assembly, and wherein said air distributor opening control assembly is activated only if a predetermined rotation is imparted to said rotary element relative to the air distributor.

7. A device for controlling kinematics of pivoting and rotary elements according to claim 1, wherein the rotary element is connected to the air distributor with an air distributor opening control assembly, and wherein said air distributor opening control assembly is activated only if a predetermined rotation is imparted to said rotary element relative to the air distributor.

* * * * *